US008250870B2

(12) United States Patent
Hein

(10) Patent No.: US 8,250,870 B2
(45) Date of Patent: Aug. 28, 2012

(54) COMBINED VORTEX REDUCER

(75) Inventor: Stefan Hein, Berlin (DE)

(73) Assignee: Rolls-Royce Deutschland Ltd Co KG (DE)

( * ) Notice: Subject to any disclaimer, the term of this patent is extended or adjusted under 35 U.S.C. 154(b) by 658 days.

(21) Appl. No.: 12/453,621

(22) Filed: May 15, 2009

(65) Prior Publication Data

US 2009/0282834 A1 Nov. 19, 2009

(30) Foreign Application Priority Data

May 19, 2008 (DE) ..... 10 2008 024 146

(51) Int. Cl.
*F02C 6/04* (2006.01)

(52) U.S. Cl. ..... 60/785; 60/782; 415/115; 415/116

(58) Field of Classification Search ..... 60/782, 60/785, 806; 415/115, 116; 416/96 R, 97 R, 416/95

See application file for complete search history.

(56) References Cited

U.S. PATENT DOCUMENTS

| | | | | |
|---|---|---|---|---|
| 3,742,706 | A | 7/1973 | Klompas | |
| 4,415,310 | A | 11/1983 | Bouiller et al. | |
| 4,919,590 | A * | 4/1990 | Stratford et al. | 415/116 |
| 5,472,313 | A | 12/1995 | Quinones et al. | |
| 7,086,830 | B2 | 8/2006 | Fitzgerald et al. | |
| 7,159,402 | B2 * | 1/2007 | Hein et al. | 60/785 |
| 7,552,590 | B2 | 6/2009 | Drevs et al. | |
| 7,828,514 | B2 * | 11/2010 | Kutz | 415/115 |
| 2002/0182059 | A1 | 12/2002 | Escure et al. | |
| 2005/0172640 | A1 * | 8/2005 | Drevs et al. | 60/785 |

FOREIGN PATENT DOCUMENTS

| | | |
|---|---|---|
| DE | 10 2004 042 295 | 3/2006 |
| EP | 1318272 | 6/2003 |
| EP | 1457640 | 9/2004 |
| EP | 1564373 | 8/2005 |
| FR | 2614654 | 11/1988 |
| FR | 2672943 | 8/1992 |

OTHER PUBLICATIONS

German Search Report dated May 19, 2008 from counterpart application.

* cited by examiner

*Primary Examiner* — William H Rodriguez
*Assistant Examiner* — Craig Kim
(74) *Attorney, Agent, or Firm* — Timothy J. Klima; Shuttleworth & Ingersoll, PLC

(57) ABSTRACT

A vortex reducer for the guidance of bleed airflows (21), is arranged in an inter-disk chamber (3) between two rotor disks (1, 2) of the compressor of a gas turbine with at least one shaft, and includes at least one ring (11) with circumferentially disposed hole passages, in which bleed air tubes (15) are arranged. In order to provide a vortex reducer, which requires small material input and, therefore, has low weight, while producing directed bleed airflows with low pressure losses, the hole passages include first hole passages (13) and second hole passages (14), and bleed air tubes (15) are provided only in the first hole passages (13), with the bleed air tubes (15) being evenly distributed on the circumference of the ring (11), and the second hole passages (14) being devoid of bleed air tubes (15).

13 Claims, 4 Drawing Sheets

COMBINED VORTEX REDUCER

Figure 1:
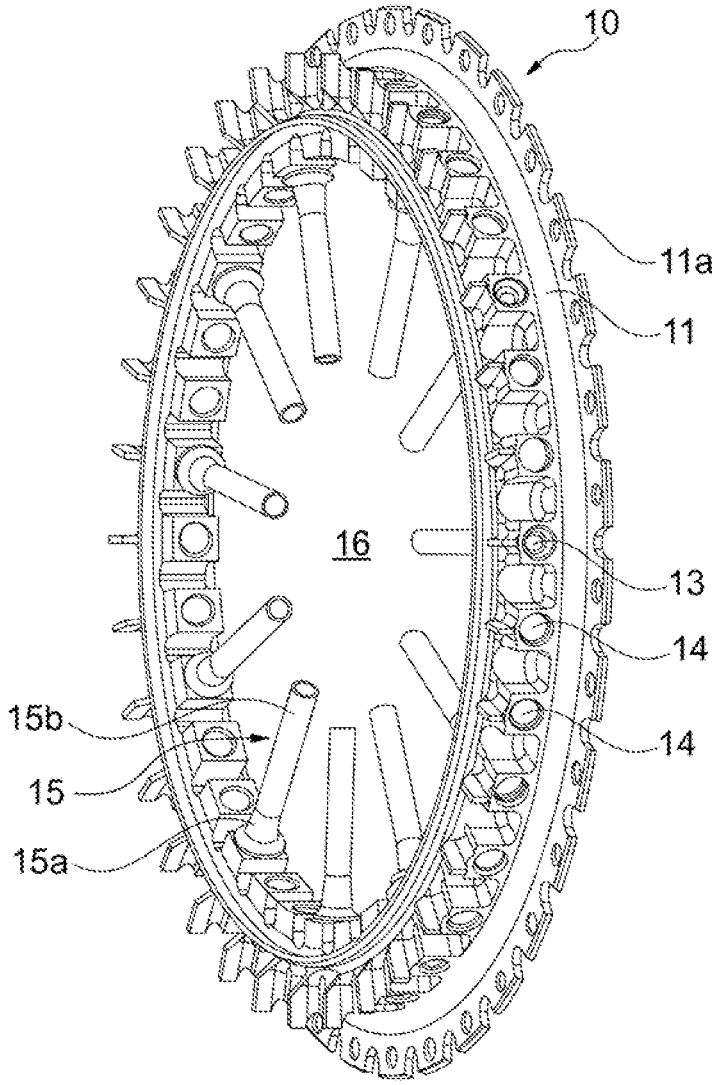

This application claims priority to German Patent Application DE102008024146.6 filed May 19, 2008, the entirety of which is incorporated by reference herein.

This invention relates to a vortex reducer for the guidance of bleed airflows. Furthermore, this invention relates a method for the guidance of bleed airflows by the vortex reducer.

In a gas turbine, bleed airflows are branched off from the airflow in the compressor to carry out the cooling of—or sealing between—certain components. The bleed airflows are branched off between two adjacent rotor disks of the compressor, e.g. in the sixth stage of the high-pressure compressor, for example via hole passages provided in one of the rotor disks of the compressor, and passed through an inter-disk chamber between the two rotor disks in the direction of the shaft.

In the inter-disk chamber, the bleed airflows form a free bleed air vortex which produces high pressure losses. In order to reduce the pressure losses, vortex reducers are used.

The bleed airflows, upon having passed the inter-disk chamber, are guided downstream along the shaft into the area of the turbine to seal there, for example, the interspaces between the rotor disks of the turbine. Subsequently, the bleed air is discharged into the gas flow.

Radial air bleed at very high rotor speeds and subsequent axial deflection of the flow in the area of the shaft entails considerable pressure loss. In order to minimize the pressure loss, vortex reducers are used in practice. In their simplest form, these vortex reducers are straight, radially inwardly directed tubular systems in which the air is positively guided.

A vortex reducer is advantageous in that the air is not increased in circumferential speed as it passes through the inter-disk chamber towards the shaft center and, therefore, does not form a free vortex. Consequently, the pressure loss resulting therefrom is less than it would be with a non-vortex reduced system.

From Specification EP 1 457 640 B1, a vortex reducer is known which includes an annular brace provided on one of the adjacent rotor disks of the compressor, a separate supporting ring and a plurality of bleed air tubes. The supporting ring is attached in the radially outer area to the adjacent rotor disks of the compressor. The bleed air tubes are arranged in openings on the circumference of the supporting ring and radially inwardly directed towards the shaft. The openings in the supporting ring adjoin hole passages in the annular brace.

In Specification EP 1 564 373 B1, a vortex reducer without supporting ring is described in which the bleed air tubes are directly fitted into the hole passages of the annular brace provided on one of the adjacent rotor disks of the compressor.

In Specification U.S. Pat. No. 7,159,402 B2, a vortex reducer with bleed air tubes is disclosed in which the bleed airflows are deflected when leaving the bleed air tubes, with the radial bleed air flows becoming one axial total airflow.

Due to the plurality of bleed air tubes, these vortex reducers require, however, high material input and, consequently, feature a high weight. Moreover, as a result of the high temperature and the friction of the bleed airflows, these vortex reducers are prone to wear at the bleed air tubes.

Specification U.S. Pat. No. 4,919,590 describes a vortex reducer composed of blades radially provided on one of the rotor disks forming the inter-disk chamber. Between the blades, ducts of the circular-segment type are thus provided by which the bleed airflows are guided into the inter-disk chamber.

With this vortex reducer, however, the bleed airflows are only partly guided, i.e. strong vortexes still exist in the inter-disk chamber. Therefore, the pressure loss is not reduced to an adequate extent.

A broad aspect of the present invention is to provide a vortex reducer which requires small material input and, therefore, has low weight while producing directed bleed airflows with low pressure losses.

In accordance with the present invention, a vortex reducer for the guidance of bleed airflows is provided, which is arranged in an inter-disk chamber between two rotor disks of the compressor of a gas turbine having at least one shaft and including at least one ring with circumferentially disposed hole passages in which bleed air tubes are arranged. Furthermore, the hole passages include first hole passages and second hole passages, with bleed air tubes being provided only in the first hole passages, with the bleed air tubes being evenly distributed on the circumference of the ring, and with the second hole passages being devoid of bleed air tubes.

Accordingly, this vortex reducer is provided with a combination of first hole passages with bleed air tubes and second hole passages without bleed air tubes. The combined vortex reducer requires less material and, therefore, has less weight than the tube-type vortex reducers according to the state of the art. Also, the formation of a free vortex in the inter-disk chamber is avoided, thereby ensuring vortex reduction. Furthermore, the vortex reducer is less susceptible to wear than the vortex reducer according to EP 1 457 640 B1 or EP 1 564 373 B1 as it has a lower number of bleed air tubes. Moreover, the centrifugal forces acting upon the ring are lower than with these two types according to the state of the art.

Preferably, the first hole passages with bleed air tubes include one third and the second hole passages two thirds of the total number of hole passages. This selection provides for both considerable weight reduction and adequate vortex reduction. Likewise, another ratio between first and second hole passages may be selected.

In a preferred embodiment, the bleed air tubes are rectilinearly arranged in the radial direction. Thus, a flow of bleed air through the vortex reducer is obtained which has particularly low loss.

Alternatively, the bleed air tubes can be curved against the direction of rotation of the compressor. This brings about that the partial airflows circumferentially enter the shaft channel at an angle of, for example, 45° to the radius and are not slowed down by radially approaching the shaft. The curvature against the direction of rotation of the compressor precludes vortex formation in the interspaces of the vortex reducer and in the shaft channel.

More particularly, the bleed air tubes are provided with fins protruding into the interspaces between the rotor disks. These fins enable the bleed airflows between the bleed air tubes to be further straightened.

In a further advantageous embodiment of the present invention, the bleed air tubes are provided with oval cross-section. The oval cross-section allows the bleed air tubes to axially better fill up the inter-disk chamber. It is thus avoided that part of the bleed air radially passes the bleed air tubes in a rotating movement.

Furthermore, radial blades which axially project into the interspaces between the bleed air tubes can be provided on at least one of the two rotor disks. Also these blades, which can be used alternatively or in addition to the above fins, provide for additional guidance of the bleed airflows.

Furthermore, at least one deflector can be provided on the radially inner ends of the bleed air tubes and/or the shaft of the gas turbine. The deflector enables vortex formation when the bleed airflows leave the vortex reducer to be reduced in the area of the shaft and, thus, the pressure loss to be further lowered.

Moreover, solution is provided by a method for the guidance of bleed airflows by means of the vortex reducer in which the bleed airflows passing through the hole passages into the bleed air tubes are guided towards the shaft. The bleed airflows transit into first partial airflows and second partial airflows, with only the first partial airflows passing through the first hole passages into the bleed air tubes, and with the second partial airflows passing through the second hole passages into the interspaces between the bleed air tubes, thereby being guided towards the shaft.

The combined application of bleed air tubes and free hole passages provides for the bleed airflows to be routed towards the shaft. Firstly, the air is vortex-reduced in the bleed air tubes and, secondly, the air flowing through the free hole passages is also vortex-reduced by the outer side of the bleed air tubes. Accordingly, the bleed air tubes preclude the formation of a free vortex in the inter-disk chamber.

In an advantageous embodiment of the present invention, the second partial airflows in the interspaces between the bleed air tubes are additionally guided by the fins on the bleed air tubes and/or the blades. Thus, provision is made for an additional vortex reduction in the partial airflow between the bleed air tubes.

Furthermore, the bleed air tubes can lead the first partial airflows and the second partial airflows in the radial direction from the outer to the inner side. Thus, a flow through the vortex reducer is obtained which is characterized by particularly low losses.

Alternatively, the bleed air tubes can lead the first partial airflows and the second partial airflows against the direction of rotation of the compressor and, also, towards the shaft. Thus, as already described in the above, an aerodynamically favorable transition from the vortex reducer to the shaft channel is obtained.

Furthermore, the deflector can deflect the first and second partial airflows issuing from the vortex reducer in the area of the shaft and produce an axial total airflow from the first and second partial airflows. Accordingly, the flow is further vortex-reduced, enabling the turbulences at the transition from the vortex reducer to the shaft channel to be further lowered.

Figure 2:
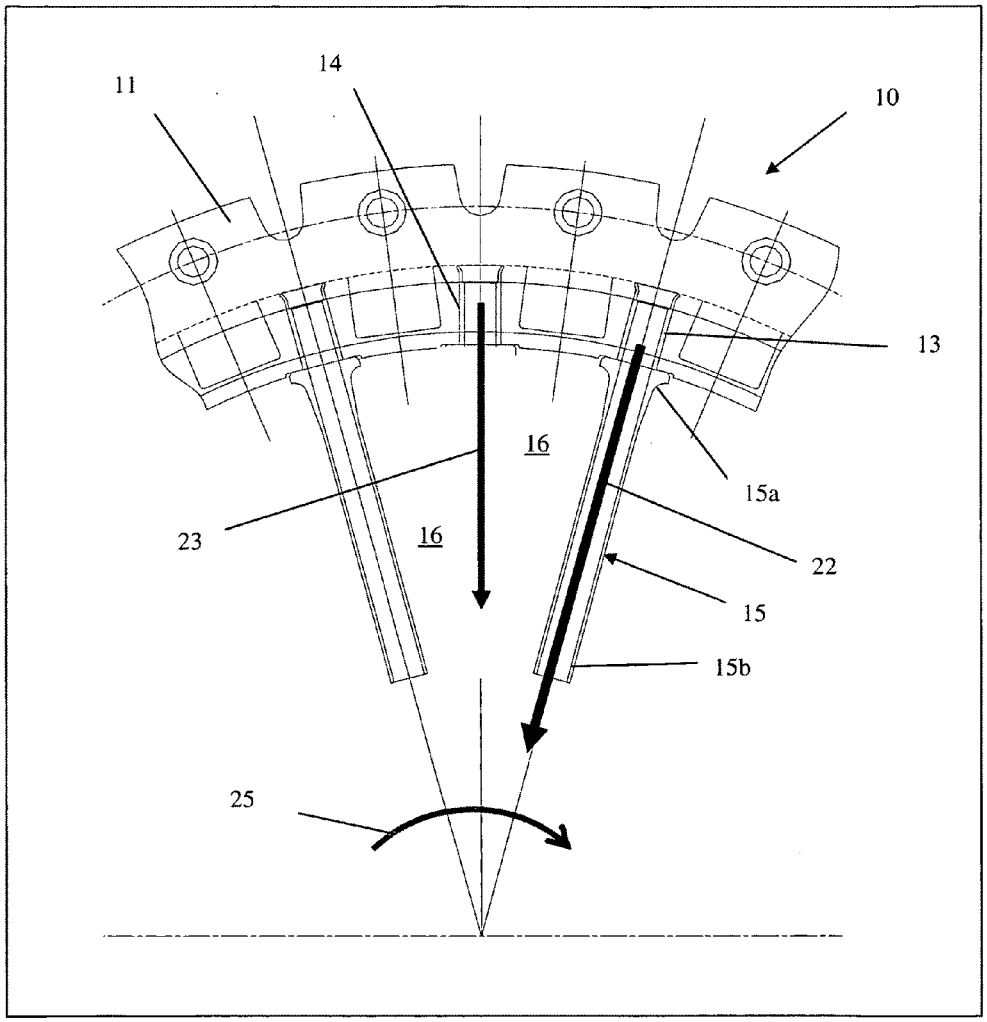
Figure 3:
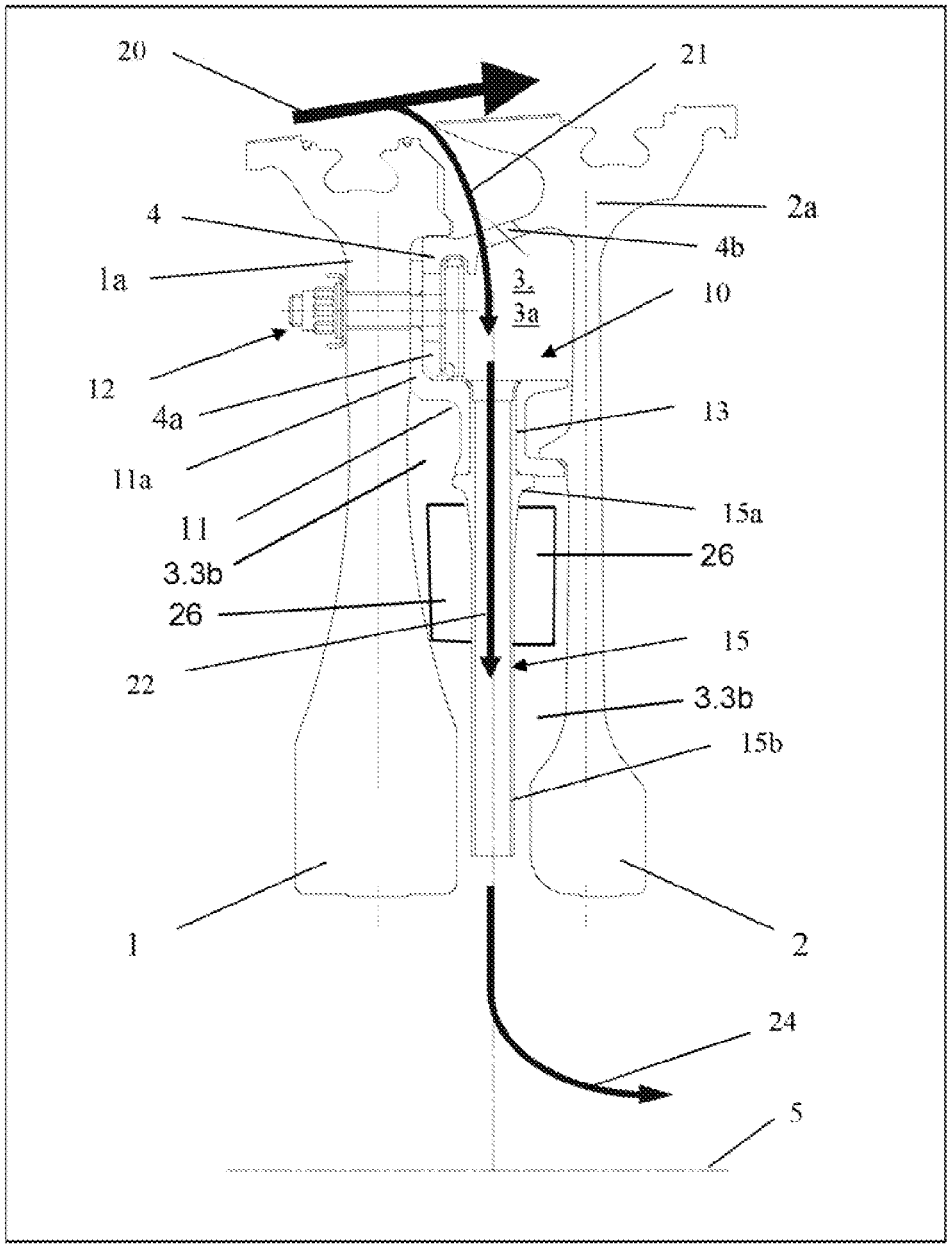
Figure 4:
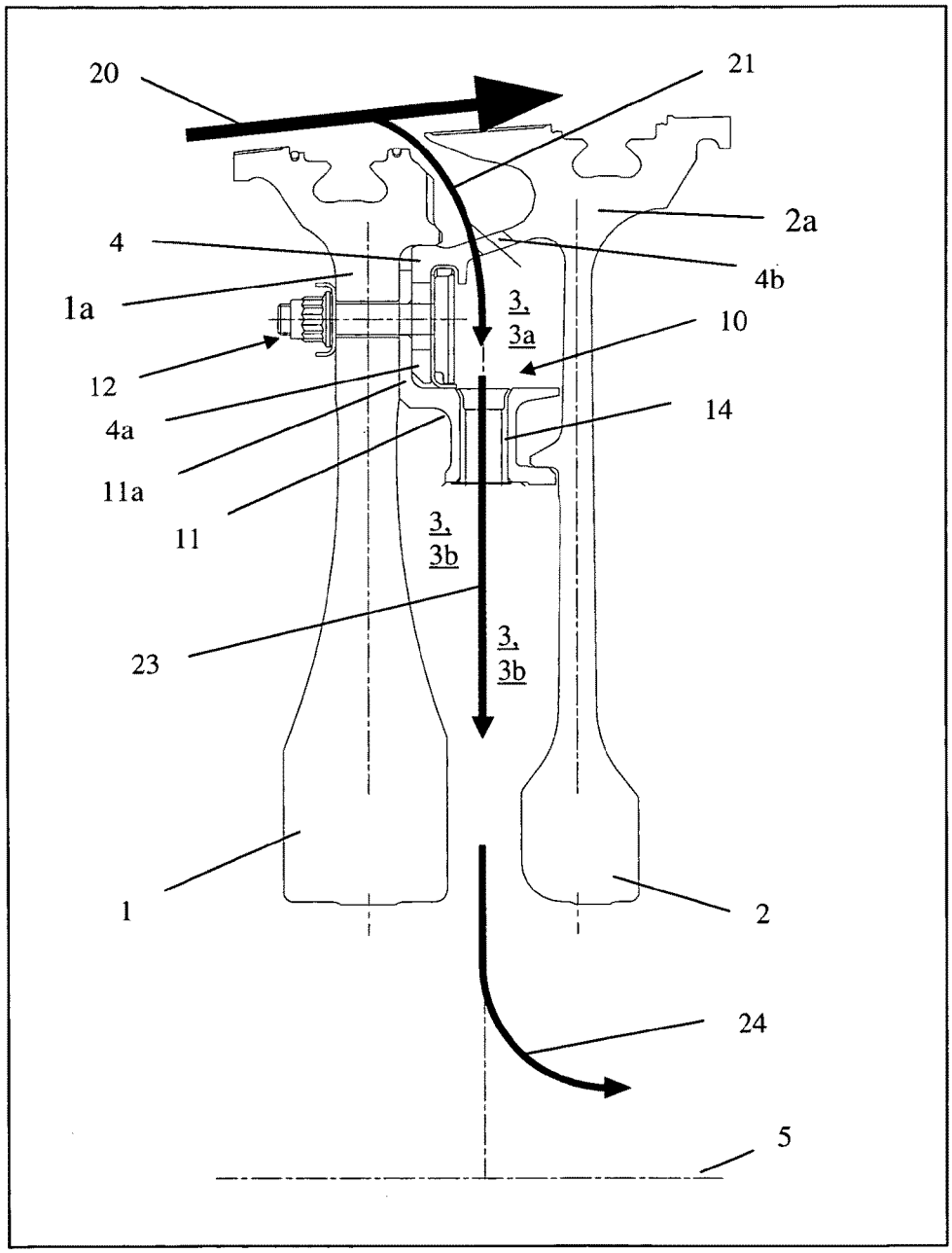

The present invention is more fully described in light of the accompanying three Figures, showing a preferred embodiment:

FIG. 1 is a perspective view of a vortex reducer in accordance with the present invention, FIG. 2 is a radial sectional view through a bleed air channel of the vortex reducer, FIG. 3 is a radial sectional view through a free hole passage of the vortex reducer, and FIG. 4 is a top view of a segment of the vortex reducer.

FIGS. 1 and 2 show a vortex reducer 10 in accordance with the present invention. The vortex reducer 10 includes a supporting ring 11 with first hole passages 13, second hole passages 14 and bleed air tubes 15.

The ring provided as supporting ring 11 has a radially outwardly angled flange 11*a*. The first and second hole passages 13 and 14 are arranged on the circumference of the supporting ring 11. In each of the first hole passages 13, a straight bleed air tube 15 is arranged to extend the passage inward in the inter-disk chamber 3 (see FIG. 3). In contrast, the second hole passages are devoid of bleed air tubes 15. One first hole passage 13 with a bleed air tube 15 circumferentially alternates with two hole passages 14 without bleed air tubes 15 each. Because of this combination of first hole passages 13 with bleed air tubes 15 and second hole passages 14 without bleed air tubes 15, the vortex reducer 10 is also referred to as a combined vortex reducer.

The bleed air tubes 15 each have a radially outer end 15*a* by which the bleed air tube 15 is fixed to the supporting ring 11. Also, the bleed air tubes 15 each have a radially inner end 15*b* which radially protrudes into the interior of the supporting ring 11. One interspace 16 each exists between two adjacent bleed air tubes 15.

FIG. 2 shows, besides the segment of the vortex reducer 10, a first partial airflow 22 and a second partial airflow 23 representing the first and second partial airflows passing through the vortex reducer 10. The first partial airflows are produced by the entry of the bleed airflows, not being shown in FIG. 2, into the first hole passages 13. The second partial airflows are produced by the entry of the bleed airflows into the second hole passages 14. A bleed airflow 21 is exemplified in FIGS. 3 and 4 each.

The first partial airflow 22 passes radially from the outer to the inner side through the first hole passage 13 and the bleed air tube 15 towards the shaft. The second partial airflow 23 passes radially from the outer to the inner side through the second hole passage 14 and the interspace 16 between two bleed air tubes 15 towards the shaft. Arrowhead 25 indicates the direction of rotation of the compressor not illustrated here and, thus, of the vortex reducer 10. FIG. 3 shows fins 26 attached to the bleed air tubes 15. These fins 26 protrude into the interspaces between the rotor disks 1 and 2. These fins 26 enable the bleed airflows 23 between the bleed air tubes 15 to be further guided.

In FIGS. 3 and 4, the vortex reducer 10 is each shown in the installation position, together with a first rotor disk 1, a second rotor disk 2 and a threaded connection 12.

The first rotor disk 1 is arranged concentrically to the centerline 5 and features a radially outer area 1*a* in which the threaded connection 12 is arranged.

The second rotor disk 2 is again arranged concentrically to the centerline 5 and has a brace 4 which is annular and, while being slightly inwardly angled in the radial direction, projects from the radially outer area 2*a* of the second rotor disk 2 towards the first rotor disk 1. The brace 4 is provided with a radially inwardly directed flange 4*a*. Also, the brace 4 is provided with openings 4*b* which are evenly distributed on its circumference. The flange 4*a* of the brace 4 is attached to the radially outer area 1*a* of the first rotor disk 1 by the threaded connection 12.

The first rotor disk 1 and the second rotor disk 2 are arranged parallel to each other in the compressor and appertain to the high-pressure compressor. Situated between the first rotor disk 1 and the second rotor disk 2 is an inter-disk chamber 3 with a radially outer part 3*a* and a radially inner part 3*b*. The radially outer part 3*a* of the inter-disk chamber 3 is situated between the supporting ring 11 of the vortex reducer 10, the second rotor disk 2, the brace 4 and the threaded connection 12. The radially inner part 3*b* of the inter-disk chamber 3 is confined by the supporting ring 11, the first rotor disk 1 and the second rotor disk 2.

In the inter-disk chamber 3, the vortex reducer 10 is arranged concentrically to the centerline 5 and parallel to the first and second rotor disk 1 and 2. The radially outwardly angled flange 11*a* of the supporting ring 11 of the vortex reducer 10 is situated between the radially inwardly angled flange 4*a* of the brace 4 of the second rotor disk 2 and the outer area 1*a* of the first rotor disk 1 and is thus also connected to the first rotor disk 1 by the threaded connection 12. The vortex reducer 10 is set up such in the inter-disk chamber 3 that the first and second hole passages 13 and 14 in the radial direction essentially point towards the openings 4*b* in the brace 4 of the second rotor disk 2.

Alternatively to the arrangement shown, in which the bleed air tubes 15 are arranged in the first hole passages 13 of the supporting ring 11, the bleed air tubes 15 can also be fitted directly into openings 4*b* of the brace 4. In this case, a separate supporting ring 11 is not required.

In lieu of the radially arranged bleed air tubes 15, bleed air tubes circumferentially curved opposite to the direction of rotation 25 of the compressor can be provided which lead the partial airflows 22 and 23 opposite to the direction of rotation 25 of the compressor.

In FIG. 3, the course of the bleed air through a first hole passage 13 and a bleed air tube 15 of the vortex reducer 10 is shown, representing further bleed airflows (not illustrated) which, as first partial airflows, pass through the first hole passages 13 and bleed air tubes 15 of the vortex reducer 10.

The exemplified bleed airflow 21 is initially branched off from the compressor airflow 20 and led through the openings 4*b* of the brace 4 into the radially outer part 3*a* of the inter-disk chamber 3. From there, a partial airflow 22 passes from the radially outer part 3*a* of the inter-disk chamber 3 through the first hole passages 13 of the vortex reducer 10 from the radially outer end 15*a* of the bleed air tube 15 through the bleed air tube 15 up to the radially inner end 15*b* of the bleed air tube 15. On the radially inner end 15*b* of the bleed air tube 15, the partial airflow exits from the vortex reducer 10 and unites with the other, first and second partial airflows into a total airflow 24 which axially passes along a shaft, which extends along the centerline 5.

In FIG. 4, the course of the bleed air through a second hole passage 14 of the vortex reducer 10 is shown, representing further bleed airflows which, as second partial airflows, pass through the second hole passages 14 of the vortex reducer 10.

The exemplified bleed airflow 21 is initially branched off from the compressor airflow 20 and led through the openings 4*b* of the brace 4 into the radially outer part 3*a* of the inter-disk chamber 3. From there, a partial airflow 23 passes from the radially outer part 3*a* of the inter-disk chamber 3 through the second hole passages 14 and along and between the air bleed tubes 15, i.e. the partial airflow 23 flows essentially in the radial direction from the outer to the inner side through the radially inner part 3*b* of the inter-disk chamber 3 towards the shaft.

Between the radially inner ends 15*b* of the adjacent bleed air tubes 15, the partial airflow 23 exits from the vortex reducer 10 and unites with the other first and second partial airflows into a total airflow 24 which axially passes along a shaft.

Thus, in operation, the partial airflow 22 exemplified in FIGS. 2 and 3 and the other first partial airflows passing through the first hole passages 13 are rectilinearly conducted in the radial direction from the outer to the inner side through the bleed air tubes 15. The partial airflow 22 is cooled down as it passes the bleed air tube 15.

In contrast to this, the partial airflow 23 exemplified in FIGS. 2 and 4 and the other, second partial airflows passing through the second hole passages 14 are radially passed from the outer to the inner side through the interspaces 16 between adjacent bleed air tubes 15, as becomes apparent from FIG. 2.

By way of the bleed air tubes 15, formation of a free vortex in the inter-disk chamber 3 in the direction of rotation 25 of the compressor is avoided and, thus, the pressure loss in the bleed air distinctly reduced. Also, a low input of material is required for the vortex reducer 10. The ratio between the free second hole passages 14 and the first hole passages 13 connected to the bleed air tubes 15 should here be as high as possible, for example 2 to 1. In addition, the entire vortex reducer should be maximized in diameter to provide guidance of the first and second partial airflows 22 and 23 over a distance, which is as long as possible.

LIST OF REFERENCE NUMERALS

1 First rotor disk
1*a* Radially outer area
2 Second rotor disk
2*a* Radially outer area
3 Inter-disk chamber
3*a* Radially outer part
3*b* Radially inner part
4 Brace
4*a* Flange
4*b* Opening
5 Centerline
10 Vortex reducer
11 Supporting ring
11*a* Flange
12 Threaded connection
13 First hole passage
14 Second hole passage
15 Bleed air tube
15*a* Radially outer end
15*b* Radially inner end
16 Interspace
20 Compressor airflow
21 Bleed airflow
22 First partial airflow
23 Second partial airflow
24 Total airflow
25 Direction of rotation
26 Fin

What is claimed is:

1. A vortex reducer for the guidance of bleed airflows, which is arranged in an inter-disk chamber between two rotor disks of a compressor of a gas turbine, comprising:

at least one ring having a plurality of circumferentially disposed hole passages, the hole passages including a plurality of first hole passages distributed evenly around a circumference of the ring and a plurality of second hole passages, the first hole passages and second hole passages positioned at outer radial positions; and a plurality of bleed air tubes respectively connected to the plurality of first hole passages for extending the respective first hole passages radially inward in an interior of the inter-disk chamber to open the first hole passages to the inter-disk chamber at inner radial positions radially inward of the outer radial positions, the second hole passages being free of bleed air tubes and opening to the inter-disk chamber at the outer radial positions at circumferential interspaces between the bleed air tubes;

outer surfaces of the bleed air tubes guiding air flows from the second hole passages through the circumferential interspaces between the bleed air tubes to reduce swirl of the air flows from the second hole passages.

2. The vortex reducer of claim 1, wherein the first hole passages account for one third of a total number of the hole passages and the second hole passages account for two thirds of the total number of the hole passages.

3. The vortex reducer of claim 2, wherein each of the bleed air tubes is rectilinearly arranged in a radial direction.

4. The vortex reducer of claim 2, wherein each of the bleed air tubes is curved against a direction of rotation of the compressor.

5. The vortex reducer of claim 2, wherein the bleed air tubes include fins protruding into the interspaces between the bleed air tubes.

6. The vortex reducer of claim 1, wherein the bleed air tubes have an oval cross-section.

7. The vortex reducer of claim 1, wherein at least one of the rotor disks includes radial blades, which axially project into the interspaces between the bleed air tubes.

8. The vortex reducer of claim 1, and further comprising at least one deflector positioned on at least one of a radially inner end of a bleed air tube and a shaft of the gas turbine.

9. A method for guiding bleed airflows in a gas turbine, comprising:

providing a vortex reducer for guiding the bleed airflows in an inter-disk chamber between two rotor disks of a compressor of the gas turbine, the vortex reducer having at least one ring having a plurality of circumferentially disposed hole passages, the hole passages including a plurality of first hole passages distributed evenly around a circumference of the ring and a plurality of second hole passages, the first hole passages and second hole passages positioned at outer radial positions;

providing a plurality of bleed air tubes positioned respectively in the plurality of first hole passages for extending the respective first hole passages radially inward in an interior of the inter-disk chamber to open the first hole passages to the inter-disk chamber at inner radial positions radially inward of the outer radial positions;

leaving the second hole passages free of bleed air tubes to open to the inter-disk chamber at the outer radial positions at circumferential interspaces between the bleed air tubes;

passing first partial bleed airflows through the first hole passages into the bleed air tubes to be guided towards a shaft of the gas turbine and to exit the bleed air tubes into the inter-disk chamber at the inner radial positions;

passing second partial bleed airflows through the second hole passages to exit the second hole passages into the inter-disk chamber at the outer radial positions at the circumferential interspaces between the bleed air tubes, guiding the airflows from the second hole passages through the circumferential interspaces between the bleed air tubes with outer surfaces of the bleed air tubes to reduce swirl of the air flows from the second hole passages.

10. The method of claim 9, and further comprising guiding the second partial airflows in the interspaces between the bleed air tubes with at least one of fins positioned on the bleed air tubes and blades of the rotors.

11. The method of claim 10, wherein the first partial airflows and the second partial airflows are guided in a radial direction from the outer to the inner side.

12. The method of claim 10, wherein the first partial airflows and the second partial airflows are guided against a direction of rotation of the compressor and also towards the shaft.

13. The method of claim 10, and further comprising deflecting the first and second partial airflows issuing from the vortex reducer in an area of the shaft and producing an axial total airflow from the first and second partial airflows.

* * * * *